US010376724B2

(12) United States Patent
Macomber

(10) Patent No.: US 10,376,724 B2
(45) Date of Patent: Aug. 13, 2019

(54) PROTECTIVE COVER DEVICE FOR A FIRE PROTECTION INSTRUMENT

(71) Applicant: Tyco Fire Products LP, Lansdale, PA (US)

(72) Inventor: Scott T. Macomber, Johnston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 160 days.

(21) Appl. No.: 15/219,954

(22) Filed: Jul. 26, 2016

(65) Prior Publication Data

US 2017/0028236 A1 Feb. 2, 2017

Related U.S. Application Data

(60) Provisional application No. 62/197,378, filed on Jul. 27, 2015.

(51) Int. Cl.

| | |
|---|---|
| ***A62C 35/68*** | (2006.01) |
| ***A62C 37/08*** | (2006.01) |
| ***A62C 37/11*** | (2006.01) |
| ***B05B 15/16*** | (2018.01) |
| ***B05B 1/26*** | (2006.01) |

(52) U.S. Cl.

CPC ..... *A62C 35/68* (2013.01); *A62C 37/08* (2013.01); *B05B 1/265* (2013.01); *B05B 15/16* (2018.02); *A62C 37/11* (2013.01)

(58) Field of Classification Search

CPC ..... A62C 35/68; A62C 37/08; A62C 37/11; A62C 37/12; A62C 37/14; A62C 37/16; B05B 1/265; B05B 15/001; B05B 3/24; B05B 15/16

USPC ..... 169/51, 37, 38; 220/724; 239/288, 239/288.3, 288.5

See application file for complete search history.

(56) References Cited

U.S. PATENT DOCUMENTS

| | | | | | |
|---|---|---|---|---|---|
| 2,389,332 | A * | 11/1945 | Tyden | A62C 37/09 | 169/37 |
| 3,388,747 | A * | 6/1968 | Hodnett | A62C 37/08 | 169/39 |
| 4,176,756 | A * | 12/1979 | Gellman | B65D 51/002 | 215/274 |
| 6,206,033 | B1 * | 3/2001 | Chang | F16K 35/10 | 137/377 |
| 6,669,111 | B2 * | 12/2003 | Vinson | A62C 31/28 | 169/37 |
| 7,273,189 | B2 * | 9/2007 | Ide | B65D 61/00 | 169/37 |
| 7,290,618 | B2 * | 11/2007 | Thomas | A62C 31/02 | 169/37 |
| D574,067 | S * | 7/2008 | Pampinella | D23/262 | |
| 7,540,330 | B2 * | 6/2009 | Orr | A62C 31/02 | 169/37 |

(Continued)

*Primary Examiner* — Arthur O. Hall
*Assistant Examiner* — Joseph A Greenlund
(74) *Attorney, Agent, or Firm* — Foley & Lardner LLP

(57) ABSTRACT

A protection device for a fire protection sprinkler having a first housing portion extending along a first housing axis defining a first internal housing chamber for receipt of one portion of a trigger assembly. A second housing portion of the protection device extends along a second housing axis and defines a second internal housing chamber for circumscribing a another portion of the trigger assembly. The first housing chamber is in communication with the second housing chamber.

26 Claims, 9 Drawing Sheets

(56) References Cited

U.S. PATENT DOCUMENTS

| | | | | |
|---|---|---|---|---|
| 7,624,813 | B2 * | 12/2009 | Ma | A62C 35/68 169/37 |
| D611,570 | S * | 3/2010 | Yang | D23/214 |
| 7,757,967 | B1 * | 7/2010 | Yang | A62C 37/08 169/37 |
| 7,900,852 | B2 * | 3/2011 | Feenstra | A62C 37/12 169/37 |
| 8,176,987 | B2 * | 5/2012 | Rekeny | A62C 37/12 169/38 |
| 8,905,151 | B2 * | 12/2014 | Silva, Jr. | A62C 37/12 169/37 |
| 9,027,660 | B2 * | 5/2015 | Oldham | A62C 37/08 169/37 |
| 9,833,659 | B1 * | 12/2017 | Nicholas | A63B 21/0004 |
| 2013/0306334 | A1 * | 11/2013 | Koiwa | A62C 35/00 169/51 |

* cited by examiner

PROTECTIVE COVER DEVICE FOR A FIRE PROTECTION INSTRUMENT

CROSS-REFERENCE TO RELATED APPLICATION(S)

This application claims the benefit of U.S. Provisional Application No. 62/197,378, filed on Jul. 27, 2015 entitled, "Protective Cover Device For a Fire Protection Instrument," which is incorporated by reference in its entirety.

TECHNICAL FIELD

This invention relates generally to protection devices for fire-fighting/protection instruments. More specifically, the present invention is directed to a protective cover device to protect the operational components or trigger assembly of a fire protection sprinkler.

BACKGROUND OF THE INVENTION

Fire protection systems utilize fire fighting/protection instruments such as, for example, sprinklers and/or spray nozzles that are activated to distribute fire-extinguishing fluid, preferably water, in the room or building. For some sprinklers, fluid discharge is controlled by a trigger assembly. These trigger assemblies support in place a closure member at the discharge outlet of the sprinkler or other instrument. The trigger can be controlled or automatically operated to displace the closure member thus allowing firefighting fluid such as water to discharge from the outlet of the instrument. One type of trigger assembly is a fusible link as provided in an automatic sprinkler. The fusible link includes a link member having two halves in which a solder element holds the halves in place to support the closure member at the sprinkler outlet. The solder member is thermally rated to melt at a threshold temperature thus, allowing the halves to separate and displace the closure member for sprinkler operation. Another type of trigger assembly includes a bulb type trigger assembly provided in an automatic spray nozzle or automatic sprinkler. The bulb type trigger assembly includes a fluid contained within a glass bulb that supports the closure assembly at the sprinkler outlet. The fluid expands upon exposure to heat and at a sufficiently high temperature, the fluid can expand so as to shatter the glass bulb. Once the bulb shatters, the closure member can be displaced to allow for fluid discharge from the sprinkler outlet.

The trigger assemblies for automatic sprinklers and spray nozzles are generally fragile and can be subject to damage during shipping, storage and/or installation. For example, the trigger assembly in a sprinkler mounted to a branch pipe of a sprinkler system can be damaged by building materials such as, for example, dry wall, pipe or other obstructions that are moved about during construction. In addition, the trigger assemblies can be damaged when mishandled or dropped by an installer. When the trigger assembly is damaged, the entire sprinkler or nozzle generally must either be discarded and/or replaced which can be a significant cost to the manufacturer, supplier, installer and/or building owner.

To protect the trigger assembly during shipping and/or installation a cover or protection device can be disposed about the sprinkler such that the trigger assembly is shielded from damage. One known protector is shown and described in U.S. Pat. No. 6,669,111 which is directed to a protector for a thermally responsive member of a sprinkler head.

Shown is a protector that pivots or separates about a hinge to envelop the frame arms of the sprinkler. Another protector is shown in Design Pat. No. D498,818 and is more specifically directed to a bulb cover. Another known protection device is shown in U.S. Pat. No. 7,757,967.

PCT Patent Application Publication No. WO 2015/191619 discloses another trigger assembly for a fire protection sprinkler that cannot be sufficiently protected by these prior art cover devices. More specifically, WO 2015/191619 discloses a trigger assembly with a hook and a strut arrangement held together by a link with a designed fracture region. The sprinkler is actuated by an electrically operated linear actuator that breaks the link along the fracture region to uncouple the hook and strut. WO 2015/191619 shows the linear actuator extending radially from the sprinkler over a radial distance that cannot be sufficiently protected by the prior art cover devices. Accordingly, the capacity of these known protective devices is limited.

SUMMARY OF THE INVENTION

Apparatus and methods of protection for a fire protection sprinkler are provided that include a preferred protection device having an internal capacity and arrangement not previously known. In one preferred embodiment, a protection device is provided for a fire protection sprinkler having a frame body extending along a sprinkler axis and a deflector member spaced from the outlet with a trigger assembly disposed between the frame body and the deflector. The sprinkler includes a trigger assembly having a frangible member and an elongate linear actuator skewed or angled with respect to the sprinkler axis for fracturing the frangible member. The preferred protective device includes a first housing portion extending along a first housing axis and defining a first internal housing chamber for receipt of the linear actuator. Preferably, the first housing axis extends perpendicular to the sprinkler axis. A second housing portion of the preferred device extends along a second housing axis and defines a second internal housing chamber for circumscribing the frangible member such that the second housing axis extends parallel to the sprinkler axis. The first housing chamber is in communication with the second housing chamber.

In a preferred embodiment of a fire protection sprinkler for shipment, the device includes a sprinkler having a deflector and a body axially spaced from the deflector along a sprinkler axis. The sprinkler includes a pair of frame arms disposed about the sprinkler axis with a trigger assembly having a frangible portion aligned with the sprinkler axis and an actuator disposed between the frame arms and extending radially from the sprinkler axis. A protective device is wrapped about the sprinkler frame and includes a first housing portion circumscribed about the actuator and a second housing portion housing the frangible portion. The first housing portion has a first radius of curvature about a first housing axis perpendicular to the sprinkler axis, and the second housing portion has a second radius of curvature about a second housing axis parallel to the sprinkler axis. The second radius of curvature is preferably greater than the first radius of curvature.

A method of protection is provided for a fire protection sprinkler having a pair of frame arms disposed about a sprinkler axis and a trigger assembly including an actuator centered between the frame arms and extending radially from the sprinkler axis. The method preferably includes disposing a first housing portion of a protective device to align a second housing portion of the protective device with frame arms; and wrapping the second housing portion about the frame arms in a snap-fit engagement.

Although the Summary of the Invention and the preferred device and methods can provide protection for a preferred sprinkler and trigger assembly arrangement, it should be understood that the preferred protection devices can protection other fire protection devices and instruments. The Summary of the Invention is provided as a general introduction to some embodiments of the invention, and is not intended to be limiting to any particular configuration or system. It is to be understood that various features and configurations of features described in the Summary of the Invention can be combined in any suitable way to form any number of embodiments of the invention. Some additional preferred embodiments including variations and alternative configurations are provided herein.

BRIEF DESCRIPTION OF THE DRAWINGS

The accompanying drawings, which are incorporated herein and constitute part of this specification, illustrate exemplary embodiments of the invention and, together with the general description given above and the detailed description given below, serve to explain the features of the preferred embodiments of the invention. It should be understood that the preferred embodiments are some examples of the invention as provided by the appended claims.

DETAILED DESCRIPTION

Figure 1:
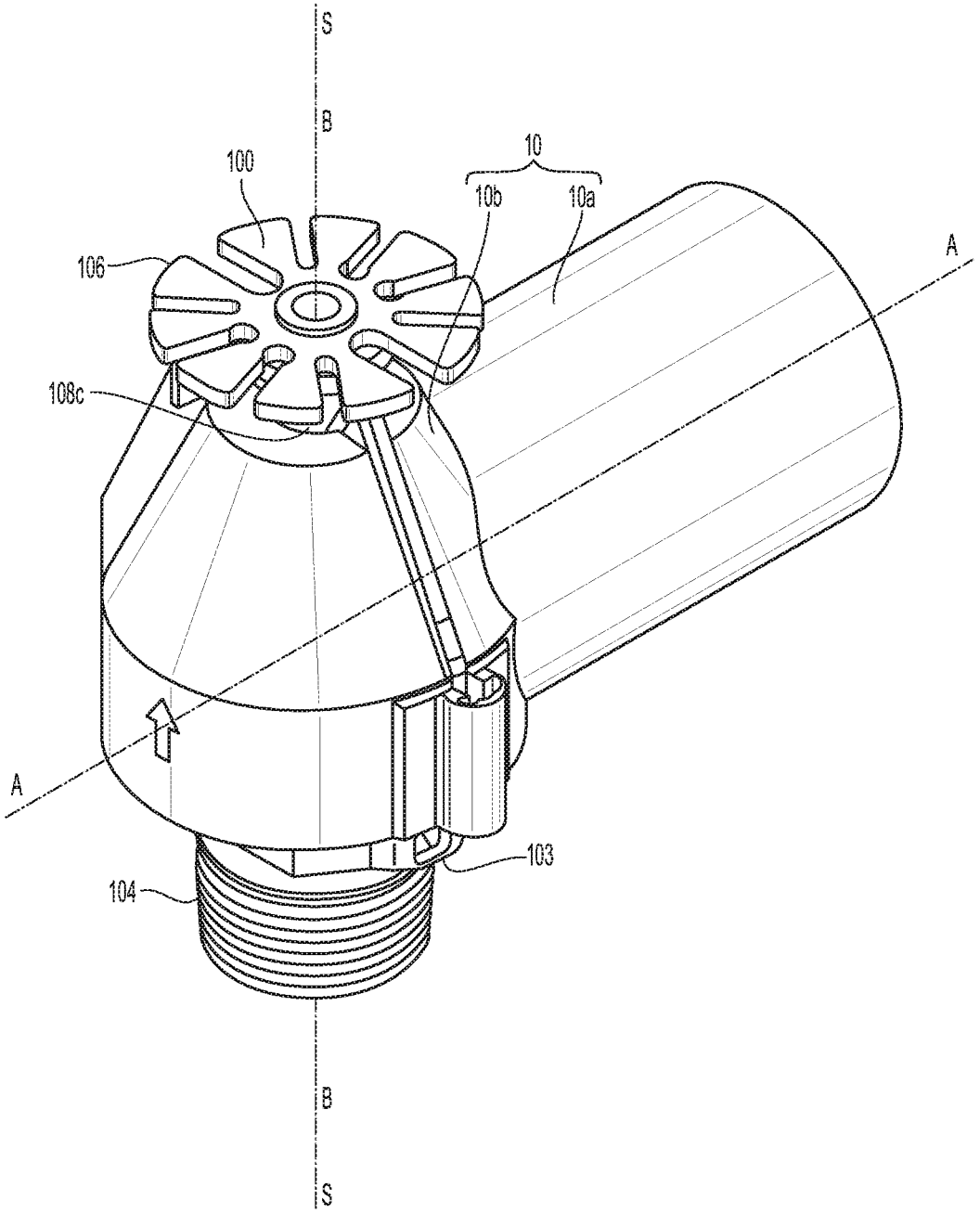
FIG. 1 is a perspective view of a preferred embodiment of a protective device disposed about a fire protection sprinkler.
Figure 1A:
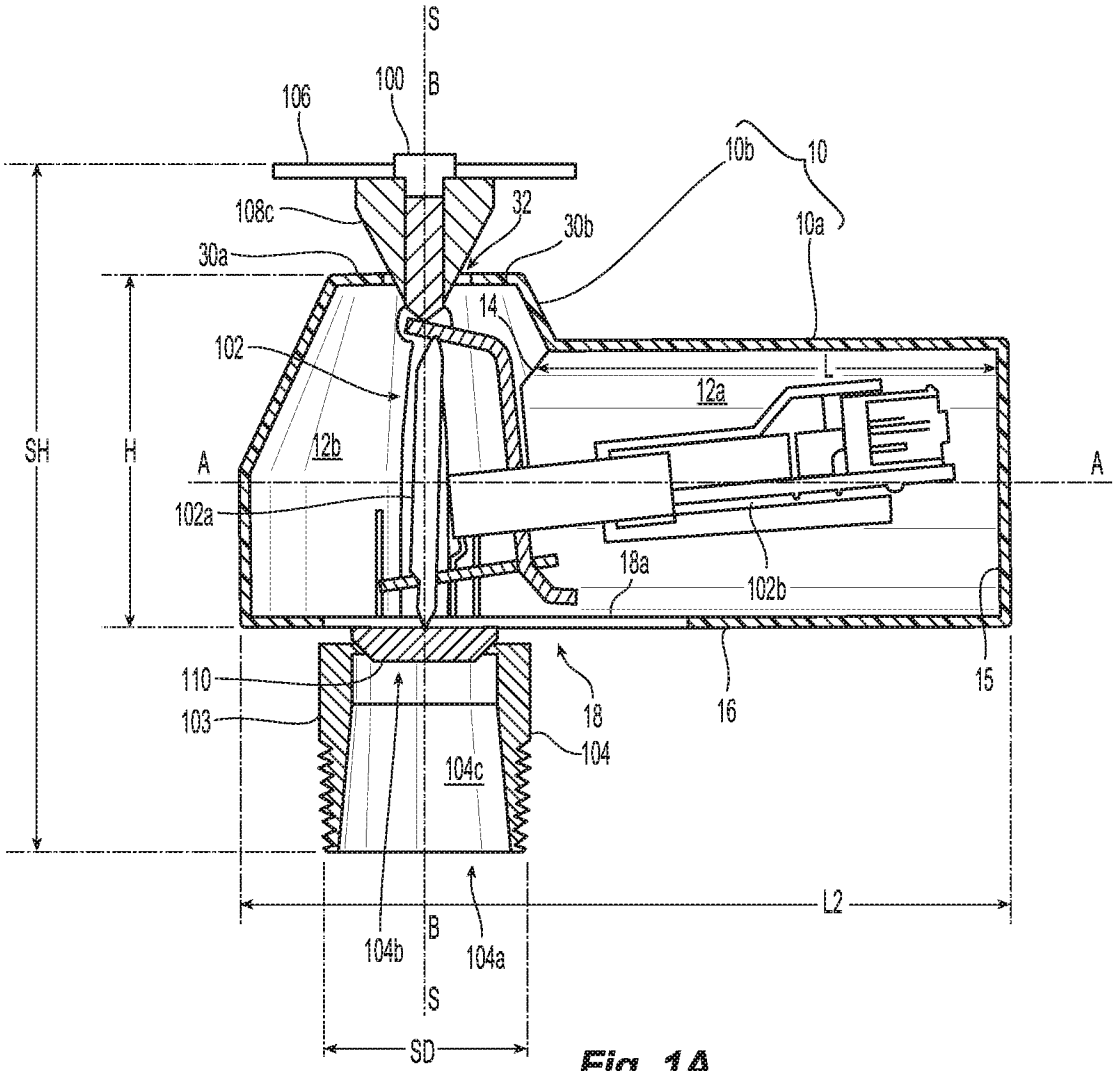
FIG. 1A is a cross-sectional view of the device of FIG. 1.
Figure 1B:
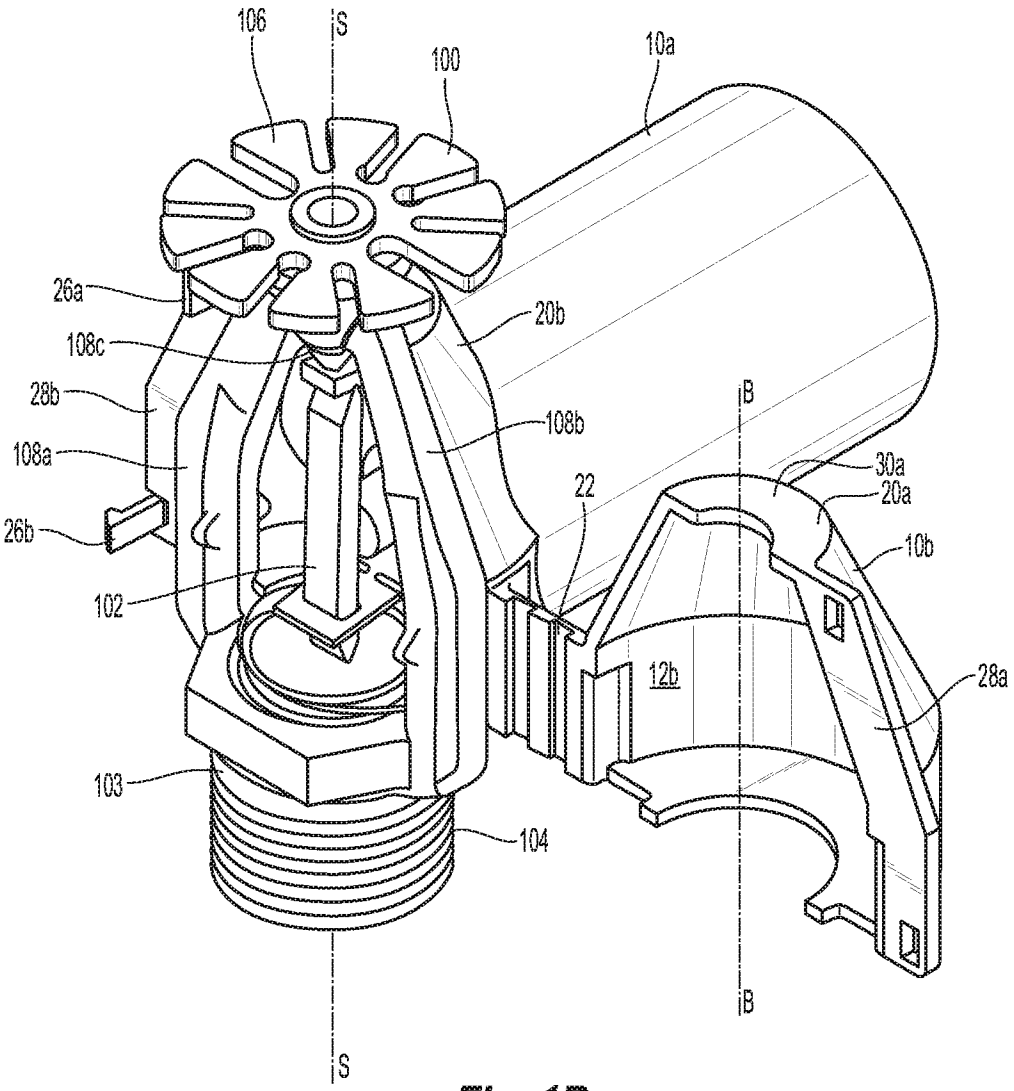
FIG. 1B is a perspective view of the device of FIG. 1 disposed about the fire protection sprinkler in an open configuration.

Shown in FIGS. 1, 1A and 1B, is an illustrative embodiment of a preferred protective device 10 disposed about a fire-fighting instrument 100, embodied as an electronically actuated sprinkler, to protect the operational components of the sprinkler 100 and in particular its trigger assembly 102. As described herein, the preferred embodiments of the protective device 10 provide for a substantially enclosed engagement with the sprinkler 100 with an internal geometry sufficient to house and protect a preferred trigger assembly 102 having operational components that extend radially outside the sprinkler frame beyond the housing capacity of previously known protective devices. The device 10 can withstand shock, movement and impact that is anticipated during handling, shipping and storage.

Referring to FIGS. 1A and 1B, a preferred sprinkler 100 for use with the protective device 10 includes a sprinkler frame 103 having a body 104 with an inlet 104*a*, and outlet 104*b* and an internal passageway 104*c* extending between the inlet and outlet 104*a*, 104*b* for receipt and discharge of a firefighting fluid. Water received at the inlet 104*a* and discharged from the outlet 104*b* impacts a deflector member 106 which is axially spaced from the outlet 104*b*. The body 104 and deflector 106 are preferably centered and axially aligned along a sprinkler axis S-S. A preferred sprinkler frame 103 for use with the protective device 10 includes at least one and more preferably includes two frame arms 108*a*, 108*b* which are diametrically disposed about the body 104 and extend from the body 104 to the deflector member 106 to converge at a frame apex 108*c*.

Discharge from the outlet 104*b* is controlled by the preferred trigger assembly 102, which controls the release of a sealing member or button 110 disposed in the outlet 104*b*. The trigger assembly includes a frangible portion 102*a* which supports the sealing member 110 in place and an actuator portion 102*b* for fracturing, separating, or otherwise ejecting the frangible portion 102*a* to release the sealing member. The frangible portion 102*a* can be, for example, a strut, lever and link arrangement, rupture disc or glass bulb; and the actuator portion 102*b* can be, for example, an electrically operated linear actuator. As schematically shown, the actuator 102*b* is disposed to operate in a manner to operate against and fracture, separate or eject the frangible portion 102*a*. Accordingly, for some embodiments, the actuator 102*b* is disposed and extends radially from the sprinkler frame 103. Moreover, for some embodiments, the actuator 102*b* can extend radially outside the periphery of the frame body 104; and additionally or alternatively, more preferably outside the periphery of the deflector member 106. The actuator 102*b* can be skewed relative to the sprinkler S-S and more particularly can be substantially perpendicular to the sprinkler S-S. This presents a unique challenge in that the actuator can extend further out of the sprinkler frame as compared to previously known sprinkler arrangements. Thus, the trigger assembly 102 and sprinkler 100 arrangement can otherwise be subject to an increased risk of damage during shipping, handling, and installation without adequate protective housing. It is believed that no previously known protective caps are capable of sufficiently protecting such an arrangement. An exemplary sprinkler frame 103 and trigger assembly 102 for use with the protective device 10 is shown and described in paragraph numbers [00109]-[00120] and FIGS. 7, 7A-7C, 8A-8B of PCT Patent Publication No. WO2015/191619, which are incorporated by reference.

The preferred device 10, as shown in FIGS. 1 and 1A, extends radially from the sprinkler frame 103 in a manner sufficient to house the trigger assembly 102 shown or any other operational component that similarly extends radially outside the sprinkler frame 103. The preferred protection device 10 includes a first housing portion 10*a* that extends along a first housing axis A-A and defines a first internal housing chamber 12*a* for receipt of the radially extending linear actuator 102*b* or other component such that the first housing axis A-A extends perpendicular to the sprinkler axis S-S and outside the sprinkler frame 103. The preferred device 10 also includes a second housing portion 10*b* which extends along a second housing axis B-B and defines a second internal housing chamber 12*b* in communication with or exposed to the first internal chamber 12*a* for receipt of the frangible portion 102*a* of the trigger assembly 102 or other component within the sprinkler frame such that the second housing axis B-B extends parallel to the sprinkler axis S-S. Accordingly, for the preferred embodiment of the device 10, the first and second housing axes A-A, B-B extend preferably substantially perpendicular to one another.

The first and second housing portions 10*a*, 10*b* and their internal chambers 12*a*, 12*b* can be further defined by geometric, dimensional and or surface features of the device 10. For example, the housing portions can be delineated by internal passageways or transitions formed in the device 10. In the preferred embodiment shown, the device 10 includes an internal transition, entrance or opening 14 from the second internal chamber 12*b* to the first internal chamber 12*a* as seen for example in FIGS. 2, 2A, 2C & 2D. The first housing portion 10*a* and its internal chamber 12*a* are preferably an elongated tubular or cylindrical member or formation to receive and house the radially extending component of the trigger assembly 102. The first housing portion 10*a* and its internal chamber 12*a* can define a first axial length L in the direction of the first housing axis A-A from its internal entrance 14 to its axial end 15. The length L can be constant or alternatively vary over the first internal chamber 12*a*. For example, the length L can vary over the height H of the second housing portion 10*b* from a base 16 of the device 10 in the direction of the second housing axis B-B. In a preferred embodiment of the device 10, the first housing portion 10 or a portion thereof is substantially circular cylindrical. As seen for example in FIG. 2D, the internal surface defining the preferred circular cylindrical internal chamber 12*a* has a preferred first radius of curvature R1 about the first housing axis A-A.

The second housing portion 10*b* is preferably configured to accommodate the frangible portion 102*a* of the trigger assembly 102 such as, for example, the strut, lever and link assembly or glass bulb element within the second internal chamber 12*b*. The second housing portion 10*b* is preferably tubular, cylindrical and more preferably frustoconical and cylindrical. In a preferred embodiment, the second housing portion 10*b* includes a preferably circular cylindrical lower or distal portion with an upper or proximal frustoconical portion. Accordingly, as seen in an open configuration of the device 10 in FIG. 2B, the preferred second housing portion 10*b* or portions thereof include a circular or semi-circular cylindrical portion defining a second radius of curvature R2 about the second housing axis B-B.

The second housing portion 10*b* and its internal chamber 12*b* also defines a second length or height H in the direction of the second housing axis B-B from the base surface 16 to a cover or proximal surface 30 of the device 10. The height H of the second housing portion is preferably sized or dimensioned to house the frangible portion 102*a* of the trigger assembly and form a preferred close fit about and more preferably a snap fit with the sprinkler frame 103 and its frame arms 108*a*, 108*b* as described herein. Moreover, the height H of the second housing portion 12*b* is preferably dimensioned to locate the proximal portion of the frame arms 108*a*, 108*b* including a portion of the apex 108*c* within the second internal chamber 12*b* and to further preferably include a distal portion of the frame arms proximate the body 104 within the second internal chamber 12*b*. The second length H can be constant or alternatively vary over the second internal chamber 12*b*. For example, the height H can vary from the second housing axis B-B to the internal opening 14 in the direction of the first housing axis A-A. As shown, the second housing portion 12*b* preferably tapers narrowly in the direction from the body 104 of the sprinkler 100 to the deflector member 106.

Each of the first and second lengths L, H can define a maximum of the respective first and second housing portions 10*a*, 10*b* and their respective internal chambers 12*a*, 12*b* and their dimensional relationships. Preferably, the elongation of the first housing portion 10*a* is greater than the height of the second housing portion 10*b* such that the first length L is greater than the second length H. For example, the first housing portion 10*a* and its internal chamber 12*a* can define a preferred maximum axial length L of 2.0-2.5 inches and the second housing portion 10*b* and its internal chamber 12*b* can define a height H ranging from 1.5-2.0 inches and more preferably ranging from 1.7-1.9 inches. Accordingly, the first and second lengths L, H define a preferred first-to-second length ratio L:H that ranges from about 1.1:1 to about 1.5:1 and more preferably about 1.2:1.

The device 10 can define or characterize relative dimensional relationships with respect to the instrument it protects. For example, where a sprinkler 100 defines a total axial height SH along its axis S-S, the first length L of the first housing portion 10*a* preferably ranges from 50-75% of the total length, more preferably ranging from 60-75% of the sprinkler height and more preferably being 65% of the total sprinkler height SH. Alternatively or additionally, where the device 10 protects a sprinkler 100 in which the frame body 104 is of a nominal and more specifically a nominal pipe diameter SD, the first length L of the first housing portion 10*a* is preferably 2 to 3 times the nominal pipe diameter of the sprinkler being protected, and more preferably 3 times the nominal pipe diameter SD of the sprinkler being protected.

Figure 2:
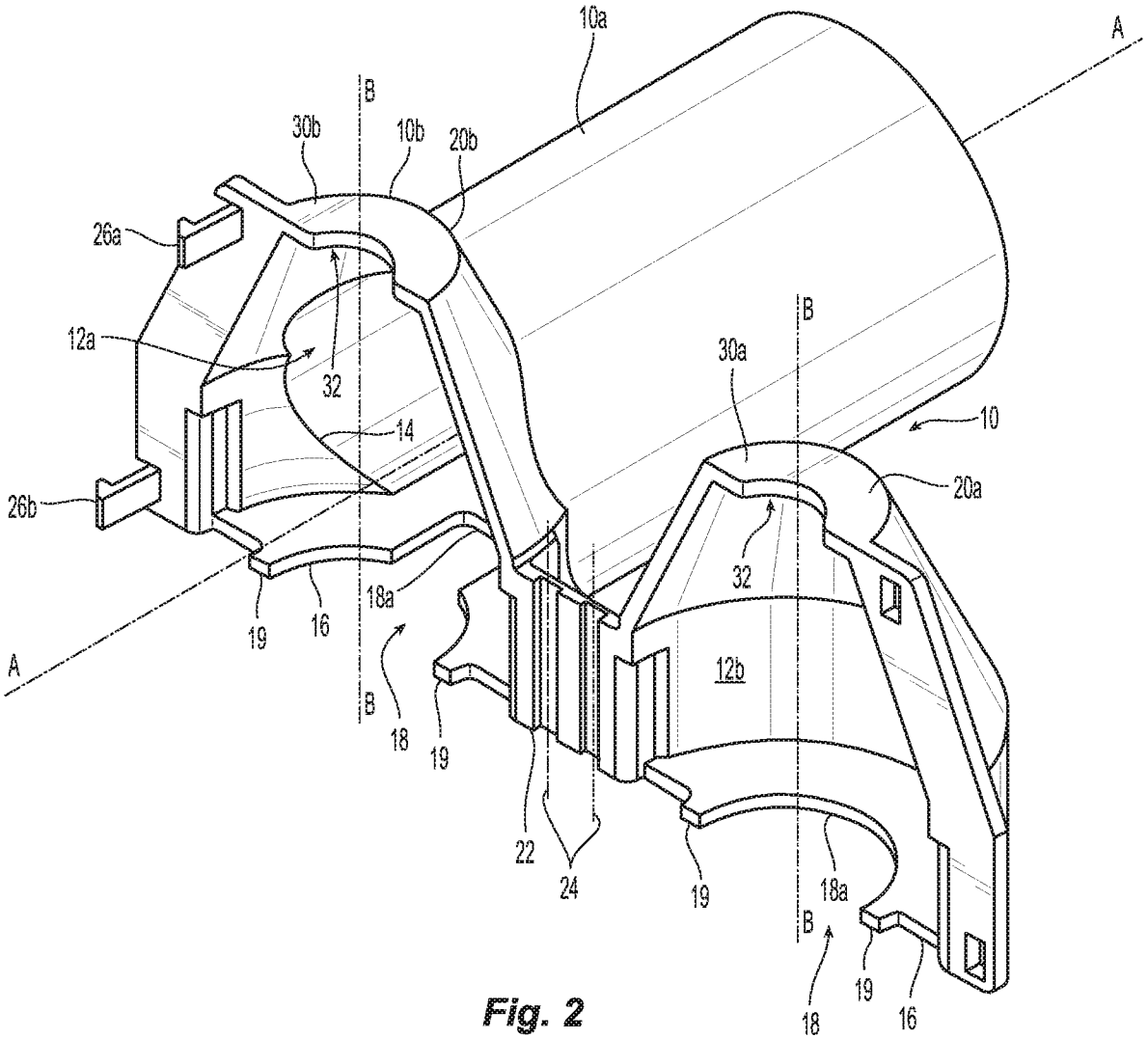
FIG. 2 is a perspective view of the device of FIG. 1 in an open configuration.

In another preferred dimensional relationship, the second radius of curvature R2 about the second housing axis B-B of the second housing portion 10*b* is preferably greater than the first radius of curvature R1 about the first housing axis A-A of the first housing portion 10*a*. In a preferred embodiment, the first radius of curvature R1 is preferably about 0.875 inch, preferably 0.85 inch and the second radius of curvature is preferably about one inch and more preferably 0.93 inch to define a preferred ratio of second radius of curvature-to-first radius of curvature R2:R1 of about 1.1:1. The first radius of curvature R1 of the first housing portion 10*a* can define in part the maximum height H1 of the first internal chamber 12*a* relative to a base 16 of the device 10 as seen in FIG. 2D. A preferred height H1 of the first internal chamber 12*a* is 1.5 inches. In a preferred embodiment of the device 10, the first and second housing portions 10*a*, 10*b* define a preferred ratio of second housing portion height-to-first housing portion height H:H1 of 1.2:1.

Figure 2A:
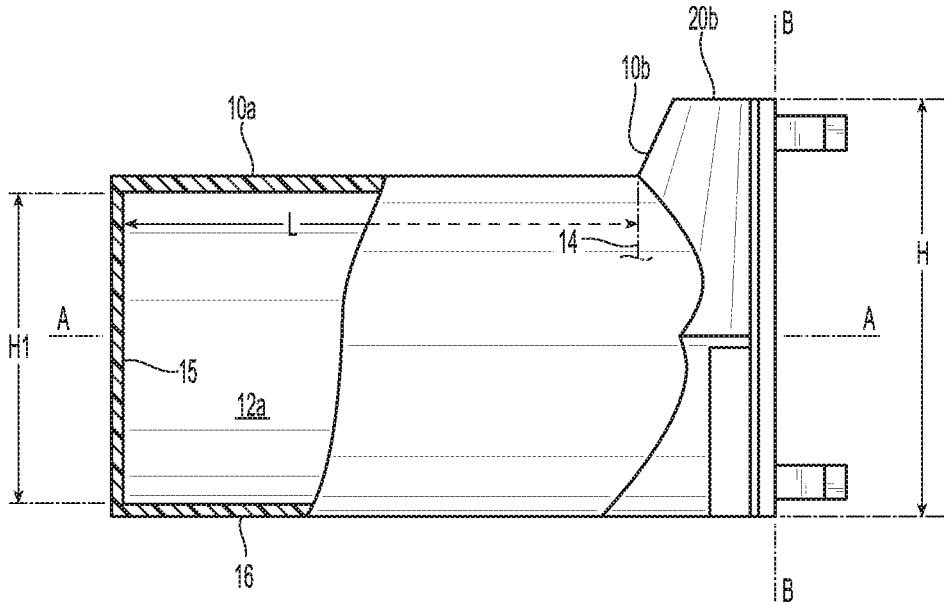
FIG. 2A is a partial cross-sectional side view of the device of FIG. 1.
Figure 2B:
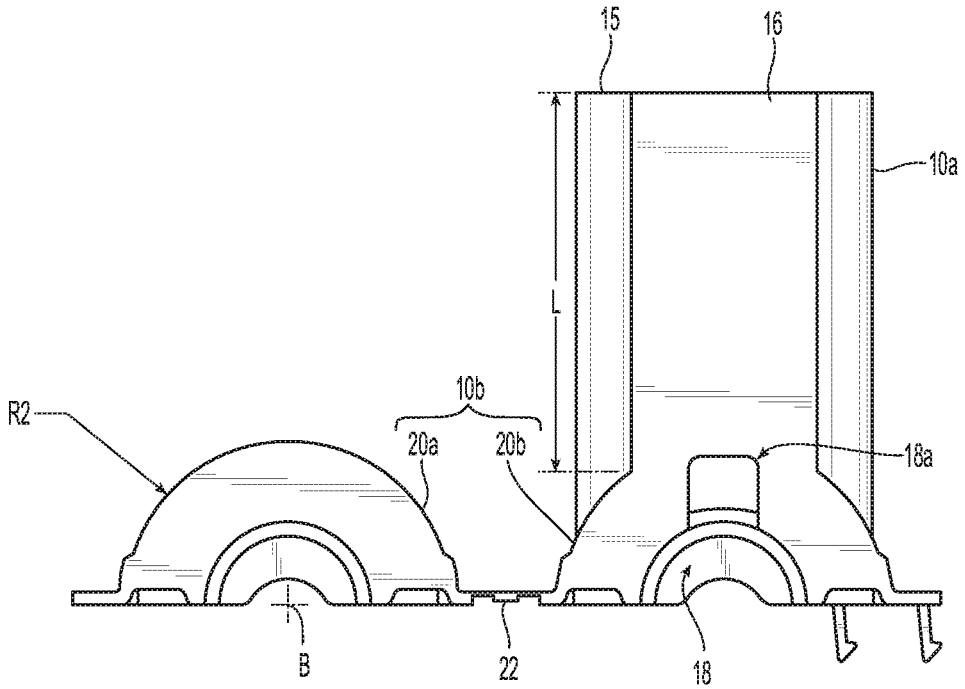
FIG. 2B is a bottom plan view of the device of FIG. 1.
Figure 2C:
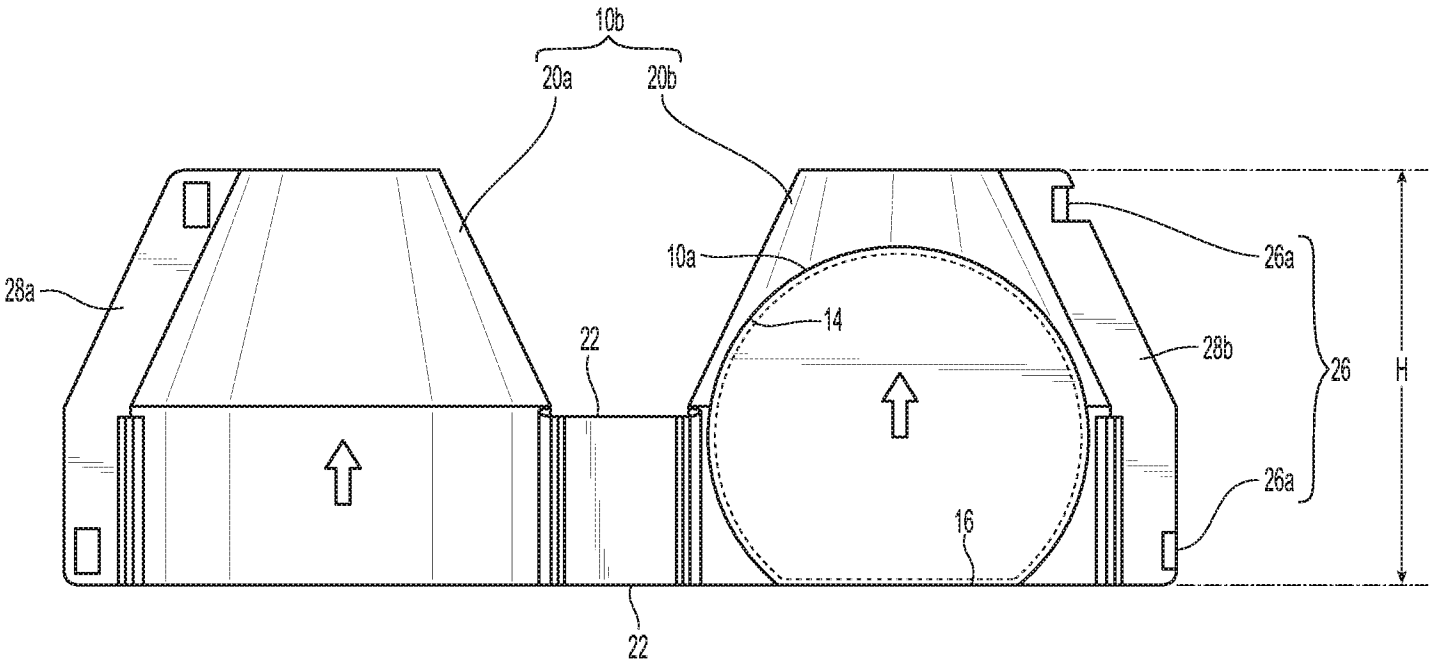
FIG. 2C is an end elevation view of the device of FIG. 1
Figure 2D:
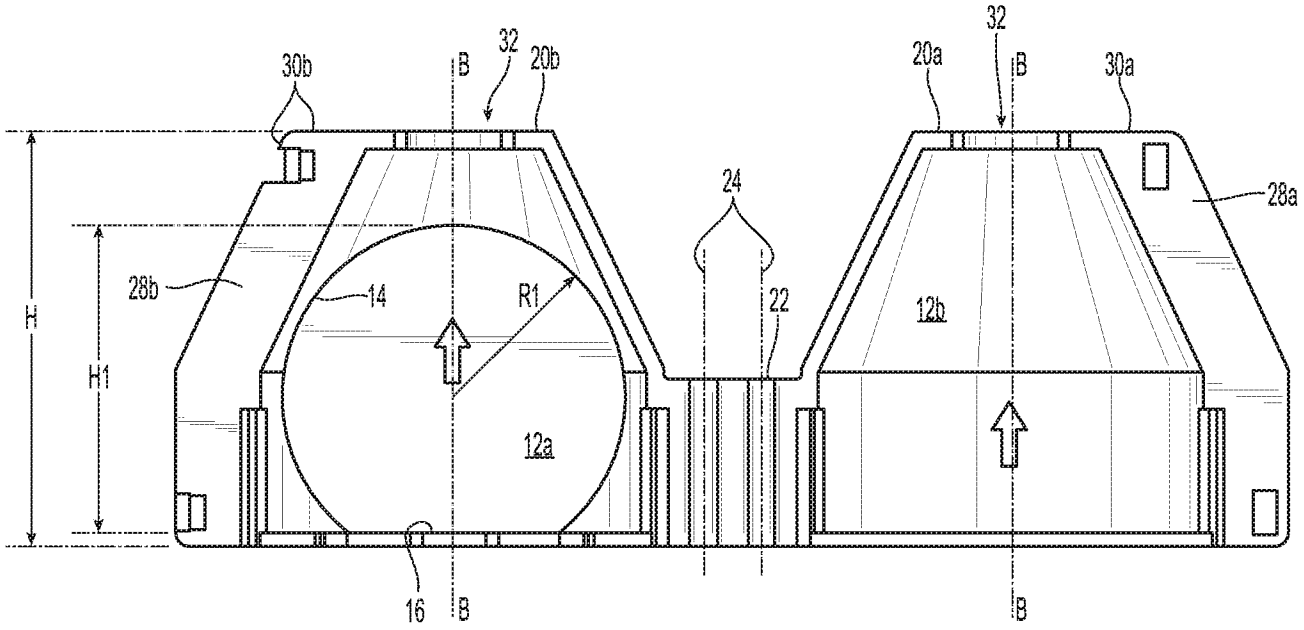
FIG. 2D is another end elevation view of the device of FIG. 1.

The base 16 provides a preferably planar external surface of the device, as seen for example in FIGS. 2A and 2B, that preferably extends over the length of the device 10 in the direction of the first housing axis A-A and further preferably spans over each of the first and second housing portions 10*a*, 10*b* to define the total axial length L2 of the device 10, seen in FIG. 1A. The preferably external planar surface 16 can facilitate easy storage of the protective device 10 on a planar shelf or in a stacked arrangement. In a preferred embodiment, in which the total axial length L2 of the base 16 is about 3.85 inches and the first housing portion length L ranges from 2.0-2.5 inches, a preferred ratio of first housing portion length-to-base length L:L2 can range from 0:5:1 to 0.6:1.

Additionally or alternatively, portions or regions of the device 10 can be distinguished by transitions, or discontinuities formed along a commonly shared surface such as, for example, the base surface 16. In the preferred protective device 10, the planar surface 16 is preferably rectangular over the first housing portion 10*a* and preferably circular over the second housing portion 10*b*. The base 16 also preferably presents a preferably common internal planar surface to each of the first and second internal chambers 12*a*, 12*b* that extends parallel to the first axis A-A without taking away from or interfering with the housing capacity of each of the first and second internal chambers 12, 12*b*.

The base 16 includes a preferred opening, penetration or slot 18 in communication with first and second internal chambers 12*a*, 12*b* through which a fire protection sprinkler or other device 100 can extend. The edges 18*a* forming the opening 18 facilitate receipt of and engagement with the sprinkler 100 and trigger assembly 102. In the preferred embodiment shown in FIGS. 2 and 2B, the opening 18 is preferably elongated in the direction of the first housing axis A-A and includes one and preferably two semi-circular edges centered about the second housing axis B-B and continuous with one or more rectilinear edges that preferably extends from the second housing portion 10*b* into the first housing portion 10*a*.

The internal edges 18*a* of the opening 18 and/or the internal surfaces of the housing portions 10*a*, 10*b* can include one or more projections 19 to contact, engage, support and/or restrain movement of the sprinkler 100 or trigger assembly 102 within the device 10. As seen, for example at FIG. 2, shown is the device 10 in an opened configuration with a plurality of projections 19 formed along the internal edges 18*a* of the opening 18. The projections 19 can be configured and located so as to engage and/or mate with, for example, surfaces of the frame arms 108*a*, 108*b*. It should be understood that the geometry and the location of the projections 19 can be configured and added to the inner surface 24 so as to accommodate varying fire-fighting/protection instrument configurations in a manner that will support the instrument in the internal chambers 12*a*, 12*b*.

As described herein, the preferred protective device 10 is preferably wrapped about the sprinkler 100 and forms a preferred snap-fit with the sprinkler frame 103 to protect the sprinkler 100 and its trigger assembly 102 for storage, shipment and/or handling. In a preferred installation of the device 10, the protective device 10 forms an open configuration in which the first housing portion 10*a* is disposed over the actuator 102*b*. The base 16 and the preferred projections 19 or other mating features preferably are aligned with the frame arms 108*a*, 108*b* or other sprinkler frame surface, as seen for example in FIG. 1B. The second housing portion 10*b* is then wrapped about the sprinkler frame 103 in a closed configuration of the device 10. In an effort to minimize the risk of damage, the device 10 and the preferred dimensions and relationships between the internal chambers allows for clearance between the device 10 and the components of the trigger assembly 102 or other operational components.

The length or height H of the second housing portion 10*b* and the openings at the base 16 are preferably configured to preferably locate the protective device 10 completely between the body 104 and the deflector member 106 in a preferred manner that minimize movement of the device 10 about the sprinkler frame 103. Moreover, the preferred location of the device 10 between the body 104 and the deflector member 106 can provide access to the tool engaging surfaces of the sprinkler 100 such as, for example, the hex-shaped multi-flat element at the base of a sprinkler body 104 as is shown in FIG. 1 and FIG. 1B. Moreover, the dimensions and location of the device 10 provides access points to a sprinkler for use of a special wrench or other sprinkler installation tool without having to remove the cover and risk damage to the operational components of the sprinkler. Accordingly, the device 10 can remain disposed about an instrument such as a sprinkler 100 during the installation process and construction of the fire protection system. The device 10 can thus provide protection to the instrument's 100 operational components as construction of the fire protection system is on-going. Once the construction of the system is completed, the device 10 can be removed from the instrument 100 and the system can be placed in service.

Figure 1C:
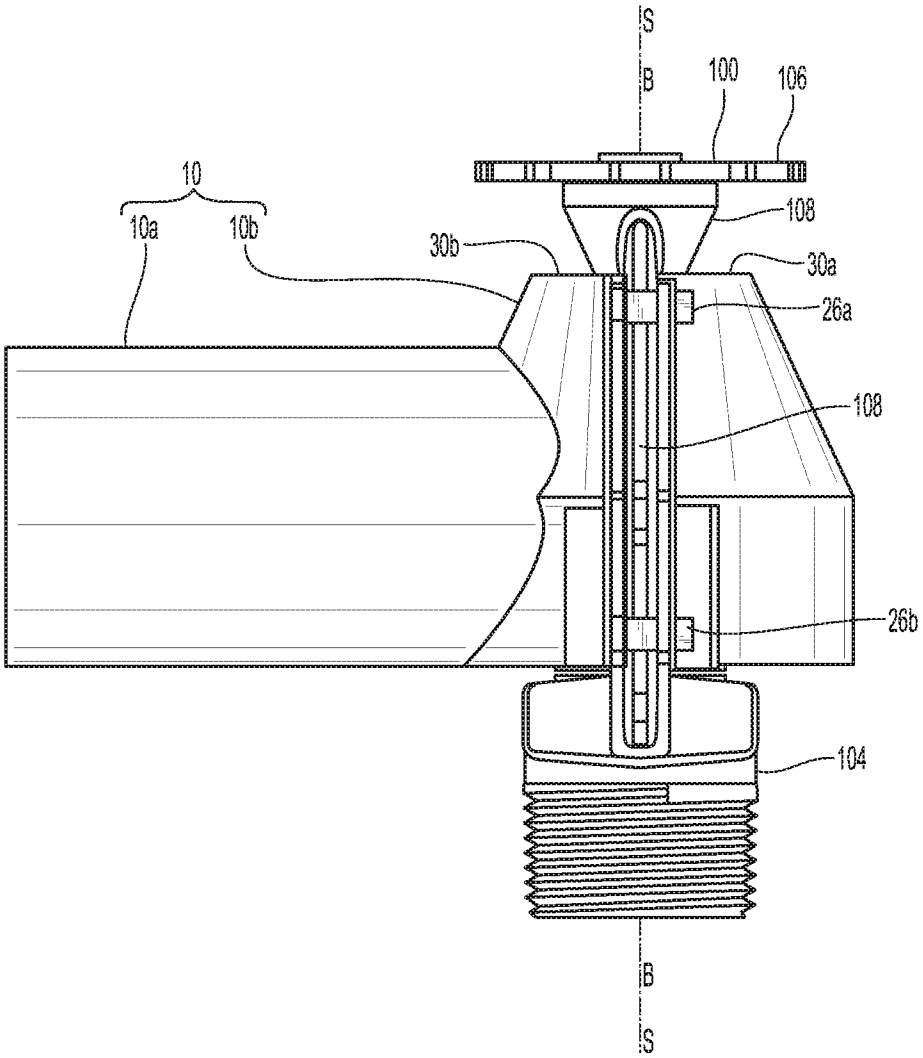
FIGS. 1C-1D are side views of the device of FIG. 1 disposed about the fire protection sprinkler in a closed configuration.
Figure 1D:
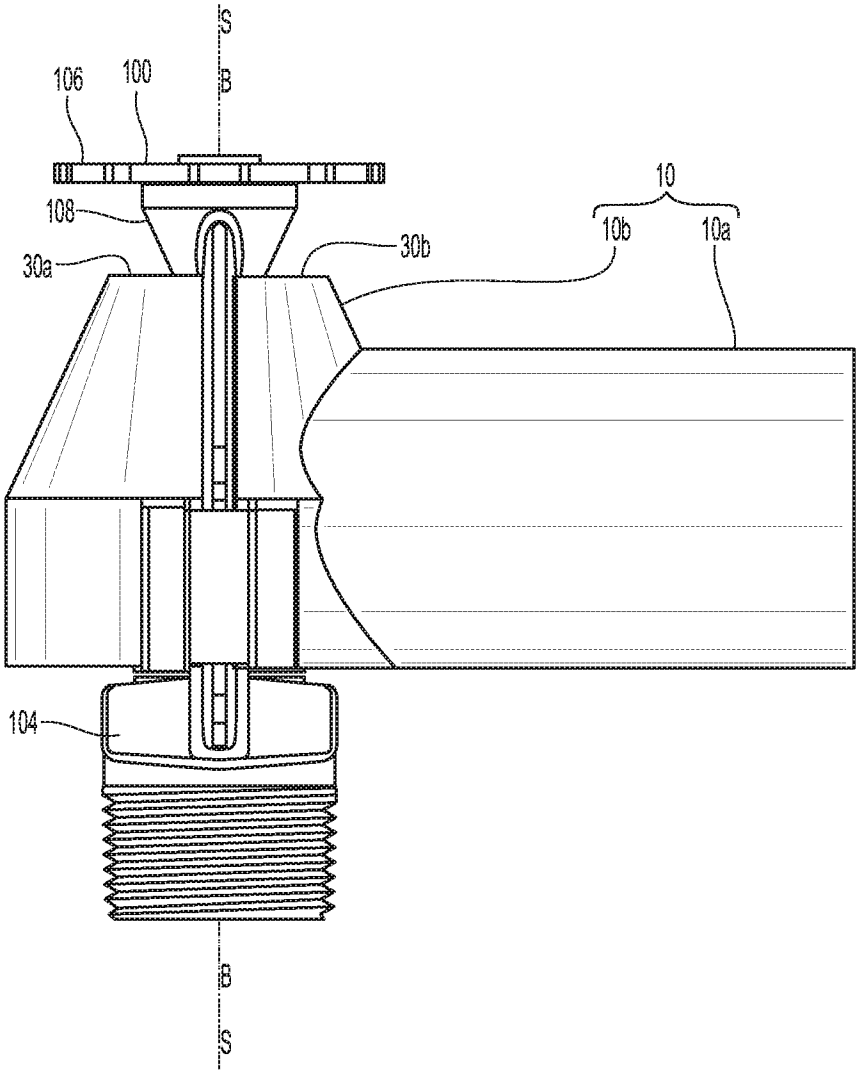

As shown, the first housing portion 10*a* provides for a preferably continuous housing surface circumscribed about the first housing axis A-A over the length of the first housing portion 10*a*. In the preferred embodiment of device 10, the second housing portion 10*b* provides for a preferably discontinuous surface circumscribed about the second housing axis B-B in order to provide a preferred wrap around and snap-fit installation as described. More specifically, the second housing portion 10*b* includes a first housing element 20*a* and a second housing element 20*b* with a hinge 22 defining a pivoted relationship between the first and second elements 20*a*, 20*b* about one or more pivot axes 24 extending parallel to the second housing axis B-B. The device 10 is preferably formed with a living hinge 22. Accordingly, the preferred device 10 has a first pivoted open configuration as seen, for example, in FIGS. 1B and 2 for receipt of the sprinkler 100 and the trigger assembly 200; and a second pivoted closed configuration as seen, for example, in FIGS. 1 and 1A for enclosing the frangible trigger assembly 102*a* in a protected manner. In the pivoted closed configuration, one or more peripheral edges of the first and second housing elements 20*a*, 20*b* preferably engage, mate or contact the frame arms 108*a*, 108*b* such that the frame arms are sandwiched or supported in between the housing elements 20*a*, 20*b* as seen, for example, in FIGS. 1C and 1D.

To maintain the protective device 10 in the closed configuration about the pivot axis 24, the device 10 and more preferably the second housing portion 10*b* includes a locking assembly 26 for holding the first and second element 20*a*, 20*b* in a closed relationship. The locking assembly 26 and hinge 22 are preferably diametrically opposed about the second housing portion 10*b* with the first housing portion 10*a* disposed between and preferably centered between the hinge 22 and the locking assembly 26. The first housing portion 10*a* preferably extends from one of the first or second housing elements 20*a*, 20*b* forming the second housing portion 10*b*. The locking assembly 26 preferably includes mating flanges 28*a*, 28*b* that extend along the outer surface of the second housing portion 10*b* in the direction of the second axis B-B. The mating flanges 28*a*, 28*b* can be shaped so as to follow or parallel the perimeter of the second housing portion 10*b*. Accordingly, the flanges 28*a*, 28*b* can angled or skewed with respect to the second axis B-B to parallel the preferred frustoconical shape of the second housing portion 10*b* as seen for example in FIGS. 2C and 2D. Alternatively or additionally, the flanges 28*a*, 28*b* can define an alternate geometry with edges that, for example, extend either parallel or perpendicular to the second axis B-B. The locking mechanism 26 further preferably includes a first cantilevered locking member 26*a* and at least a second cantilevered locking member 26*b* disposed on one flange 28*a* with correspondingly positioned receiving members on the other mating flange 28*b* for forming the preferred snap fit to enclose the second housing portion. In the preferred pivoted closed configuration of the device 10, the flanges 28*a*, 28*b* preferably engage, mate or contact the frame arms 108*a*, 108*b* such that the frame arms are sandwiched or supported in between the flanges 28*a*, 28*b* as seen, for example, in FIGS. 1C and 1D. The cantilevered members 26*a*, 26*b* can be axially spaced and aligned with one another in the direction of the second housing axis B-B, as seen for example in FIG. 2. In another preferred embodiment, the cantilevered locking members 26*a*, 26*b* are preferably spaced apart and offset from one another in a direction perpendicular to the second axis B-B, as seen for example in FIG. 2C.

The second housing portion 10*b* preferably includes a cover surface 30 spaced from and parallel to the base 16 and preferably orthogonally to the second housing axis B-B to cover or substantially enclose the second internal chamber 12*b*. Each of the first and second elements 20*a*, 20*b* of the second housing portion 10*b* includes a cover surface 30*a*, 30*b*, which are preferably semi-circular in shape to substantially circumscribe the second housing axis B-B and form a second void or opening 32 aligned with the second housing axis B-B through which the sprinkler 100 can penetrate. The void 32 is shown as a substantially circular but can be any geometry provided the void 32 permits penetration of the device 100 in the closed configuration of the device 100 and preferably provide sufficient surface area to shield and protect the operational components of the frangible portion of the trigger assembly disposed within the second internal chamber 12*b*. The void 32 is further preferably configured such that a sufficient amount of surface area of the distal end surface 18 is available to surround the trigger assembly and shield foreign matter from entering the internal chamber 12*b* and damaging the operational components of the fire-fighting/protection instrument. The void 32 can alternatively be defined by any geometry provided the void permits penetration of the fire protection sprinkler and further provides sufficient surface area to shield and protect the operational components of the fire protection sprinkler 100 disposed within the chamber 12*b*.

Generally, the device 10 is configured to provide a protective housing for operational components of a fire protection sprinkler 100 and more preferably provide for the preferred first and second internal chambers 12*a*, 12*b* to house the components of the trigger assembly 102. The overall geometry and dimensions of the device 10 are preferably configured to minimize material and size of the device 10 while providing housing capacity not available in current protective devices. It should be understood that alternate external geometries, dimensions and/or profiles of the device 10 are possible provided the preferred internal chambers house the components of the trigger assembly.

As shown, the first housing portion 10*a* preferably extends radially or laterally from the second housing portion 10*b*. In the case of the embodiment shown, the first housing portion 10*a* is more preferably formed integrally with one of the first and second elements 20*a*, 20*b* of the second housing portion and centered between the hinge 22 and the locking assembly. Accordingly, in a preferred installation of the device 10, the first housing portion can be disposed over the actuator 102*b* to center and locate the device 10 for wrapping about the sprinkler frame. The device 10 can be formed and is preferably molded, and more preferably injected molded, as a unitary construction using a polymer material such as, for example, High Density Polyethylene (HDPE) material. Alternatively, the housing portions 10*a*, 10*b* can be formed as separate components provided the components can be joined together to form the preferred internal chambers 12*a*, 12*b* to house and protect the fire protection device 100 and its operational components. For example, a first cylindrical tubular housing component can be formed for a snap fit connection with a separately formed second frusto-conical cylindrical housing component.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A protection device for a fire protection sprinkler, the fire protection sprinkler having a frame body extending along a sprinkler axis and a deflector member spaced from an outlet with a trigger assembly disposed between the frame body and the deflector, the frame body and deflector member being centered and axially aligned along the sprinkler axis, the trigger assembly extending radially outside the frame body, the protection device comprising:

a first housing portion extending along a first housing axis and defining a first internal housing chamber for receipt of a first portion of the trigger assembly such that the first housing axis extends perpendicular to the sprinkler axis, the first housing portion defines a first length in the direction of the first housing axis; and a second housing portion extending along a second housing axis and defining a second internal housing chamber for circumscribing a second portion of the trigger assembly such that the second housing axis extends parallel to the sprinkler axis, the first internal housing chamber in communication with the second internal housing chamber, the second housing portion defines a second length in the direction of the second housing axis, the first length being greater than the second length, a ratio of the first length to the second length ranges from 1.1:1 to 1.5:1, the sprinkler defines a total axial height, the first length being 50 to 75 percent of the total axial height, the first housing portion is cylindrical having an inner surface spaced from the first housing axis and defining a radius of curvature about the first housing axis, the inner surface extending along the first housing axis from a first surface end coupled with the second housing portion to a second surface end opposite the first surface end.

2. The device of claim 1, wherein the first housing portion defines a first length in the direction of the first housing axis and the second housing portion defines a second length in the direction of the second housing axis, the first length being greater than the second length.

3. The device of claim 1, wherein the ratio is 1.2:1.

4. The device of claim 1, wherein the first housing portion extends radially with respect to the sprinkler axis outside the periphery of the frame body and the periphery of the deflector member.

5. The device of claim 1, wherein the sprinkler defines a total axial height, the first length being 60-75% of the total axial height.

6. The device of claim 2, wherein the sprinkler frame body defines a nominal pipe diameter, the first length being 2-3 times the nominal pipe diameter.

7. The device of claim 1, wherein the first housing portion is circular cylindrical.

8. The device of claim 7, wherein the radius of curvature of the first housing portion defines a first radius of curvature the second housing portion includes a semi-circular cylindrical portion defining a second radius of curvature, the first and second radii of curvature defining a ratio of second radius of curvature-to-first radius of curvature of about 1.1:1.

9. The device of claim 1, wherein each of the first and second housing portions define a planar base surface that extends perpendicular to the second housing axis.

10. The device of claim 9, wherein the planar base surface includes an opening in communication with first and second internal chambers.

11. The device of claim 10, wherein the opening includes an elongated slot extending from the second housing portion to the first housing portion, the slot including at least one semi-circular edge continuous with a rectilinear edge.

12. The device of claim 11, wherein a portion of the elongated slot is rectangular.

13. The device of claim 12, wherein the first housing portion is at least partially circularly cylindrical, the base surface along the first housing portion is a rectangular planar surface.

14. The device of claim 9, wherein the first housing portion defines a first height from the base surface and the second housing portion defines a second height from the base surface, a ratio of the second height to the first height being about 1.2:1.

15. The device of claim 14, wherein the base surface defines an axial length and a ratio of the first length to the axial length of the base ranging from 0.5:1 to 0.6:1.

16. The device of claim 1, wherein the second housing portion includes a first element, a second element, and a hinge defining a pivoted relationship between the first and second element along a pivot axis extending parallel to the second housing axis, the first housing portion extending from one of the first and second elements.

17. The device of claim 16, further comprising a locking assembly for holding the first and second element in a closed relationship about the pivot axis, the locking assembly and hinge being diametrically opposed about the second housing portion with the first housing portion disposed between the hinge and the locking assembly.

18. The device of claim 17, wherein the locking assembly includes a flange having a first cantilevered locking mechanism and a second locking mechanism axially spaced from one another in the direction of the second housing axis and wherein the hinge is a living hinge.

19. The device of claim 18, wherein the first and second locking mechanisms are offset from one another in a direction perpendicular to the second housing axis.

20. The device of claim 1, wherein the second housing portion is frusoconical.

21. A fire protection sprinkler for shipment comprising:

a sprinkler having a deflector and a body axially spaced from the deflector along a sprinkler axis, the sprinkler including a pair of frame arms disposed about the sprinkler axis, the sprinkler including a trigger assembly having a frangible portion aligned with the sprinkler axis and an actuator disposed between the frame arms and extending radially from the sprinkler axis; and a protective device wrapped about a sprinkler frame and including a first housing portion circumscribed about the actuator and a second housing portion housing the frangible portion, the first housing portion having a first radius of curvature about a first housing axis perpendicular to the sprinkler axis, the first housing portion defines a first length in the direction of the first housing axis, the second housing portion having a second radius of curvature about a second housing axis parallel to the sprinkler axis, the second radius of curvature being greater than the first radius of curvature, the second housing portion defines a second length in the direction of the second housing axis, the first length being greater than the second length, a ratio of the first length to the second length ranges from 1.1:1 to 1.5:1, the sprinkler defines a total axial height, the first length being 50 to 75 percent of the total axial height, the first housing portion being an elongate tubular member having an inner surface spaced from the first housing axis with its radius of curvature about the first housing axis perpendicular to the sprinkler axis to receive and house the actuator extending radially from the sprinkler axis, the inner surface extending along the first housing axis from a first surface end coupled with the second housing portion to a second surface end opposite the first surface end.

22. The sprinkler of claim 21, wherein the first housing portion is cylindrical and the second housing portion is frustoconical and cylindrical.

23. The sprinkler of claim 22, wherein the second housing portion includes a first element and a second element in a pivoted relationship to form a wrapped snap fit about the sprinkler frame, the first housing portion extending radially from one of the first and second elements of the second housing portion.

24. The sprinkler of claim 23, wherein the second housing portion includes a hinge and a locking assembly, the first housing portion being centered between the hinge and the locking assembly.

25. The sprinkler of claim 21, wherein the sprinkler body defines a nominal pipe diameter, the first housing portion extending from the sprinkler axis to a radial length 2-3 times the nominal pipe diameter.

26. A method of protecting a fire protection sprinkler having a pair of frame arms disposed about a sprinkler axis and a trigger assembly including an actuator centered between the frame arms and extending radially from the sprinkler axis, the method comprising:

disposing a first housing portion of a protective device to align a second housing portion of the protective device with the frame arms the second housing portion having a second housing axis parallel to the sprinkler axis; and wrapping the second housing portion about the frame in a snap-fit engagement, wherein the first housing portion includes an elongated cylindrical member having an inner surface spaced from a first housing axis of the first housing portion with a radius of curvature extending about the first housing axis extending perpendicular to the sprinkler axis and the disposing includes receiving the radially extending actuator within the first housing portion, the first housing portion defines a first length in the direction of the first housing axis, the second housing portion defines a second length in the direction of the second housing axis, the first length being greater than the second length, a ratio of the first length to the second length ranges from 1.1:1 to 1.5:1, the sprinkler defines a total axial height, the first length being 50 to 75 percent of the total axial height, the inner surface extending along the first housing axis from a first surface end coupled with the second housing portion to a second surface end opposite the first surface end.

* * * * *